US008069597B2

(12) United States Patent
Kim

(10) Patent No.: US 8,069,597 B2
(45) Date of Patent: Dec. 6, 2011

(54) MULTIPURPOSE ADVERTISEMENT BOARD

(76) Inventor: Jae-Sik Kim, Yangsansi (KR)

( * ) Notice: Subject to any disclaimer, the term of this patent is extended or adjusted under 35 U.S.C. 154(b) by 146 days.

(21) Appl. No.: 12/374,013

(22) PCT Filed: Jan. 6, 2007

(86) PCT No.: PCT/KR2007/000092

§ 371 (c)(1),
(2), (4) Date: Dec. 15, 2009

(87) PCT Pub. No.: WO2008/013348

PCT Pub. Date: Jan. 31, 2008

(65) Prior Publication Data

US 2010/0101125 A1 Apr. 29, 2010

(30) Foreign Application Priority Data

Jul. 24, 2006 (KR) ..... 20-2006-0019827 U

(51) Int. Cl.
*G09F 11/18* (2006.01)

(52) U.S. Cl. ..... 40/518; 40/471

(58) Field of Classification Search ..... 40/518, 40/471; 160/241; 52/786.11
See application file for complete search history.

(56) References Cited

U.S. PATENT DOCUMENTS 4,813,198 A * 3/1989 Johnston et al. ..... 52/171.3
4,864,783 A * 9/1989 Esposito ..... 52/86
5,467,266 A * 11/1995 Jacobs et al. ..... 700/56
6,931,773 B2 * 8/2005 Bihr ..... 40/518

* cited by examiner

*Primary Examiner* — Gary Hoge
(74) *Attorney, Agent, or Firm* — Biotech Beach Law Group PC

(57) ABSTRACT

Disclosed is a multipurpose advertisement board having a film between glass plates of a double glazed window, wherein pieces of steel wire are provided to respective ends of the film and the pieces of steel wire can be wound around winding rollers, so that the multipurpose advertisement board can display a variety of patterns printed on the film, and also can act as a normal glass window. The multipurpose advertisement board includes a double glazed window that includes two or more glass plates, a film moving in the space of the double glazed window, an upper winding roller and a lower winding roller installed at the upper and lower portions of the double glazed window for winding the film, pieces of steel wire connected to the left and right ends of the film, and steel wire winding grooves provided to the upper and lower winding rollers.

5 Claims, 10 Drawing Sheets

[Fig. 1]
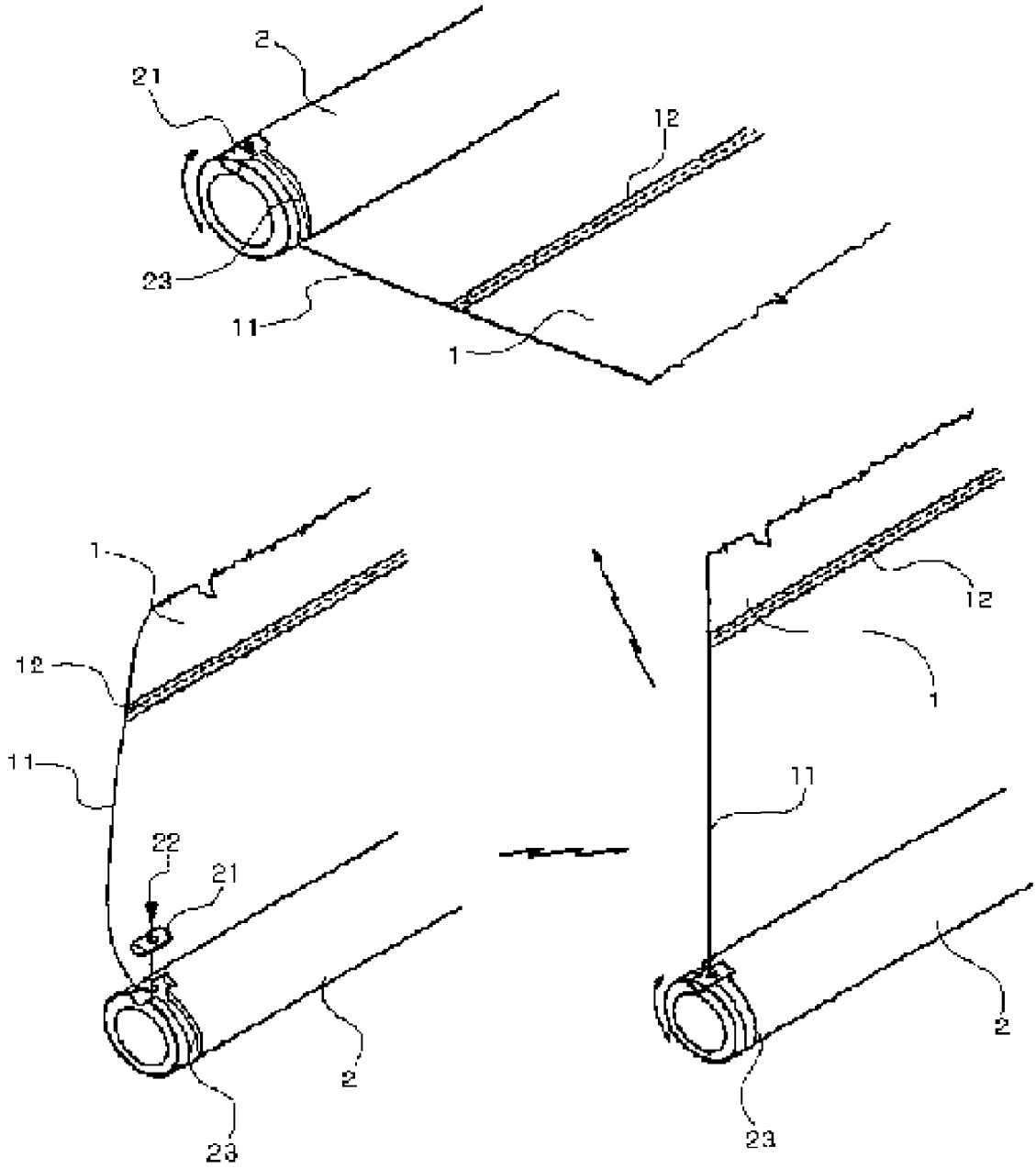

[Fig. 2]
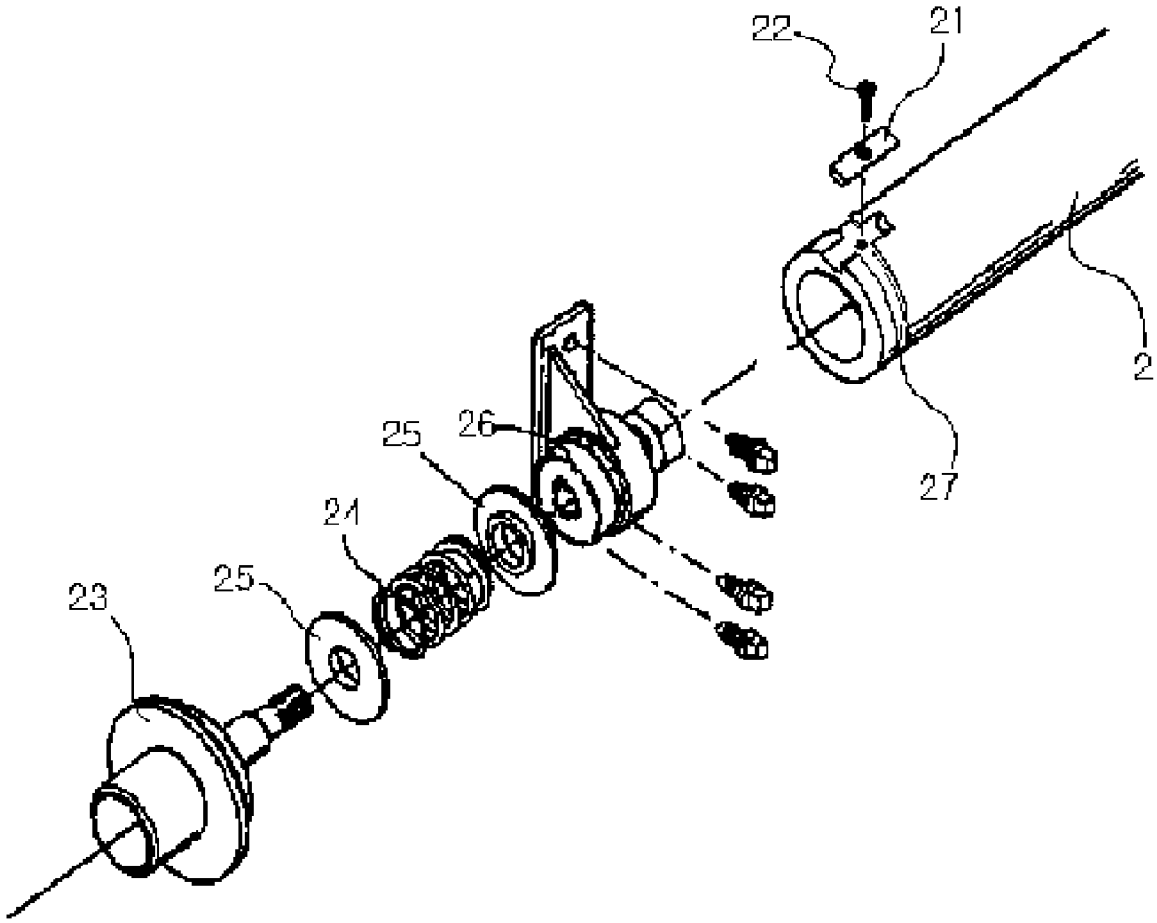

[Fig. 3]
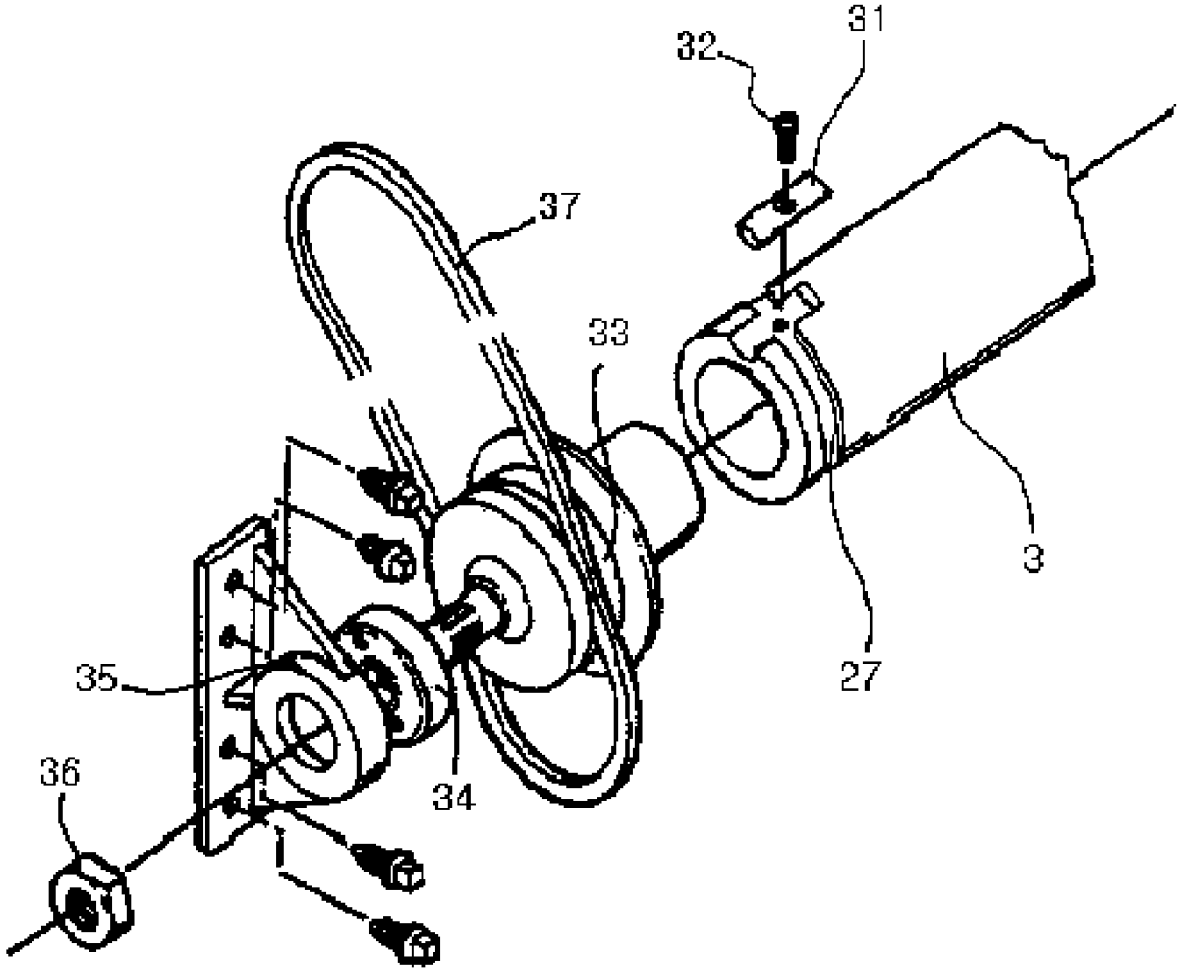

[Fig. 4]
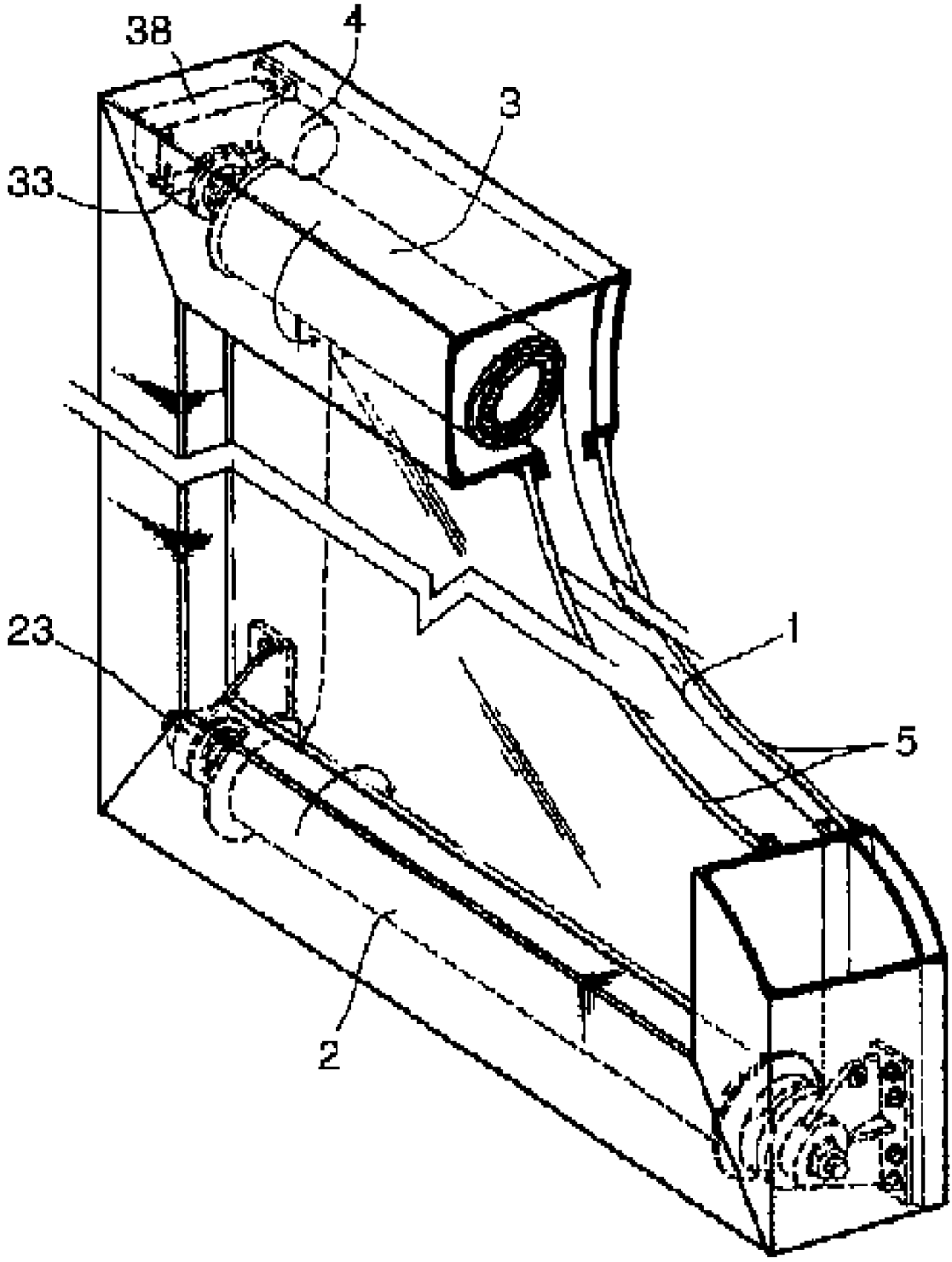

[Fig. 5]
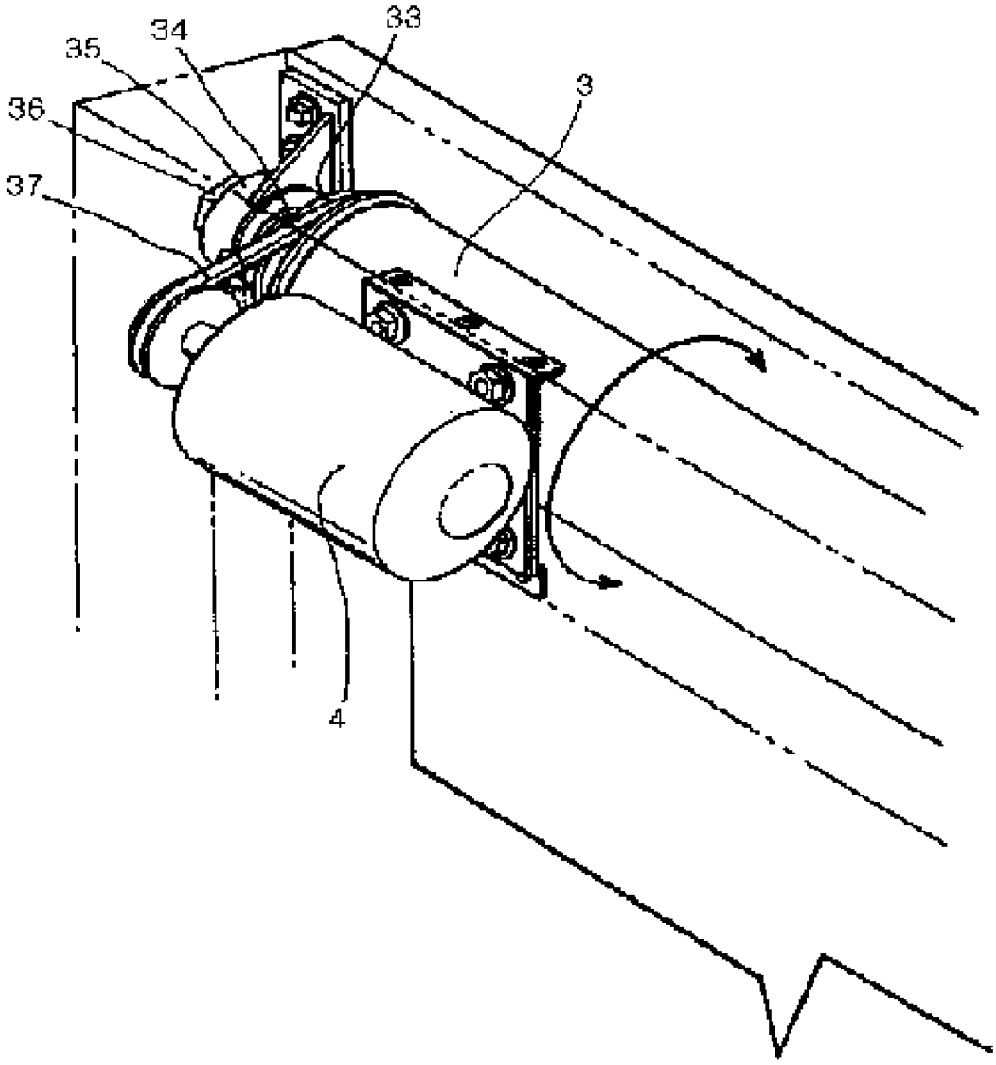

[Fig. 6]
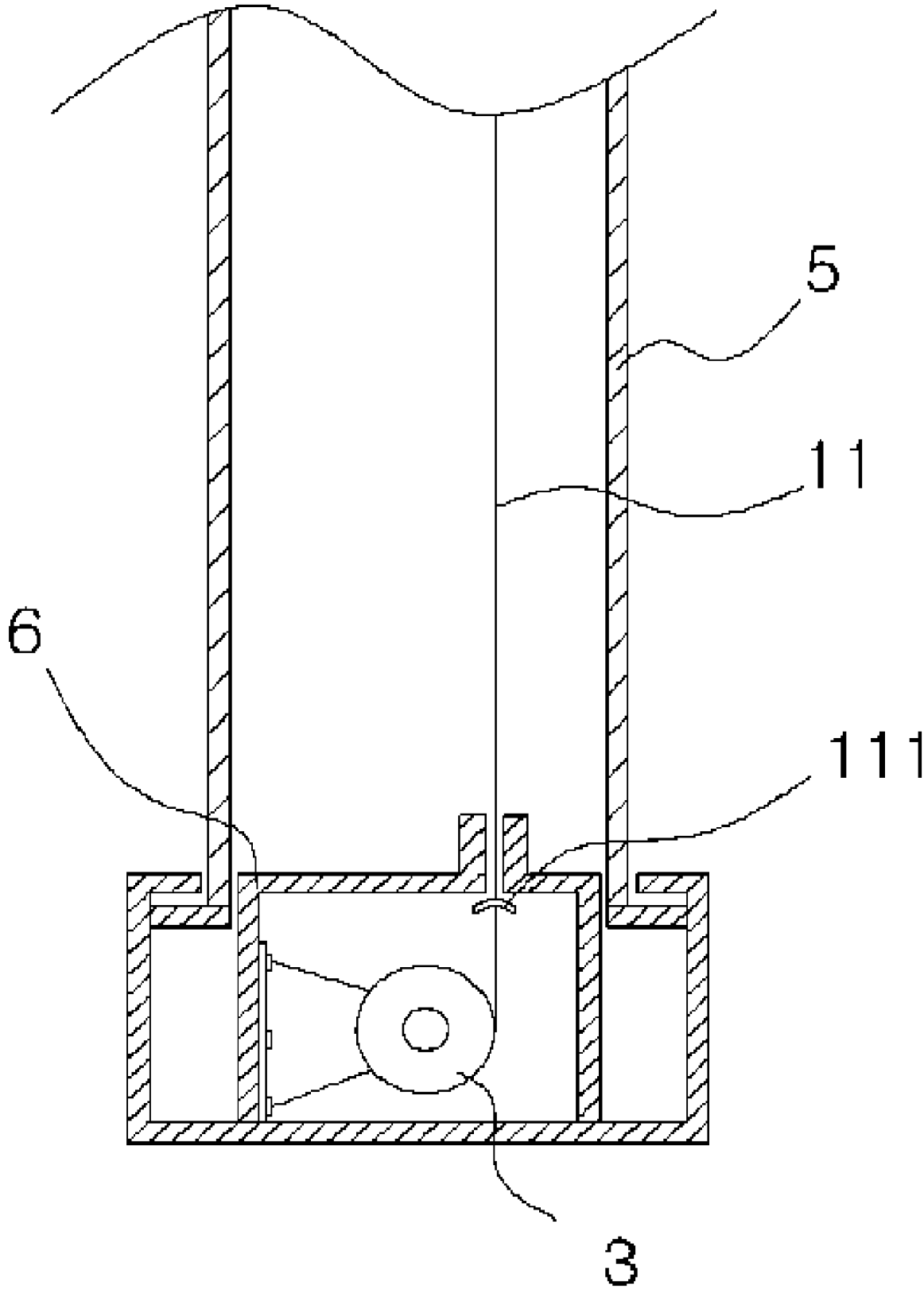

[Fig. 7]
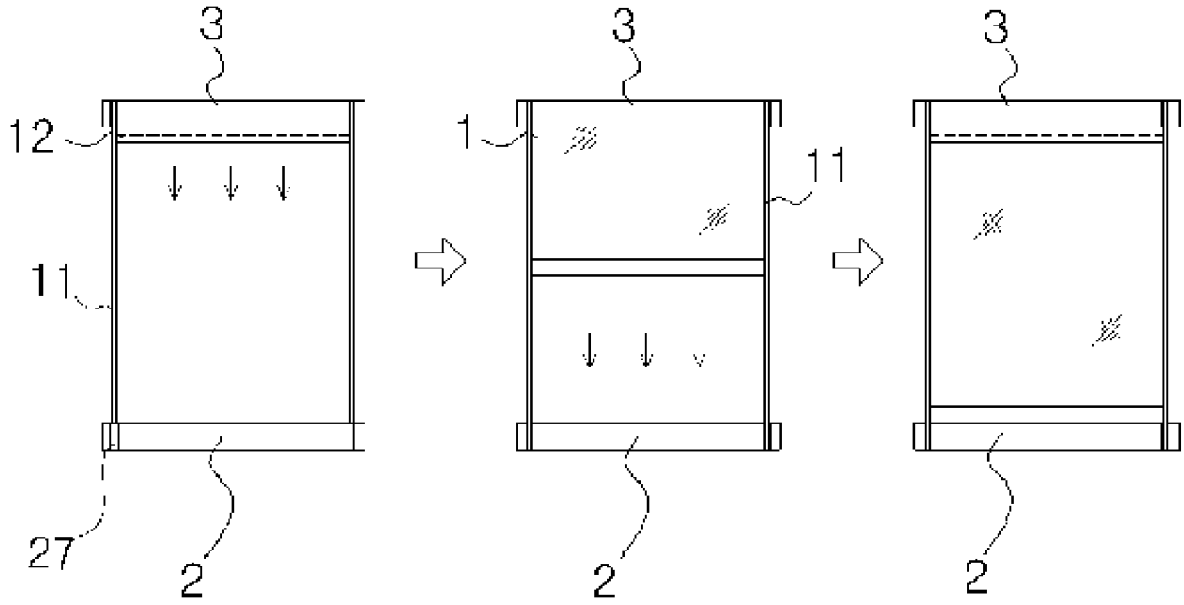

[Fig. 8]
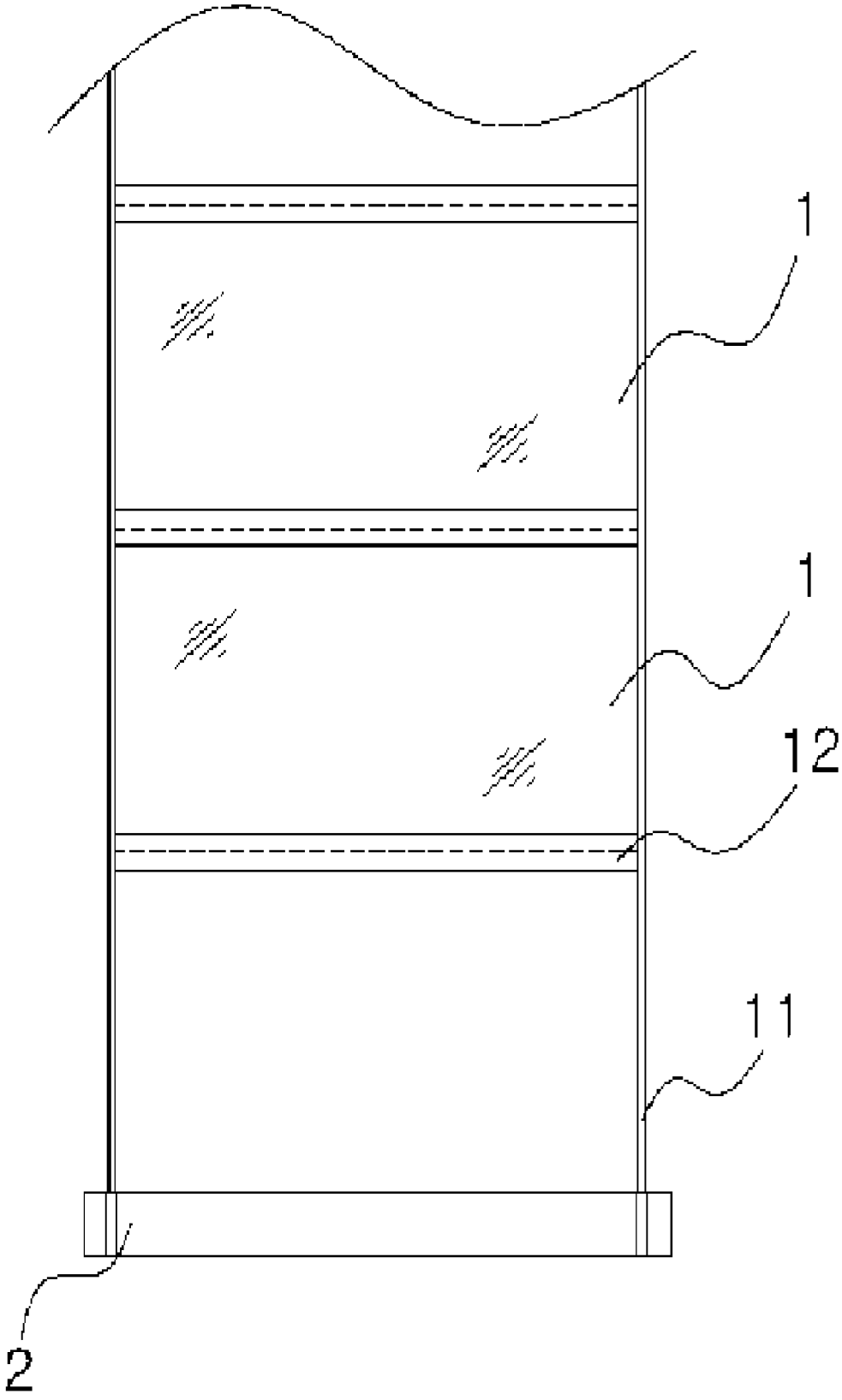

[Fig. 9]
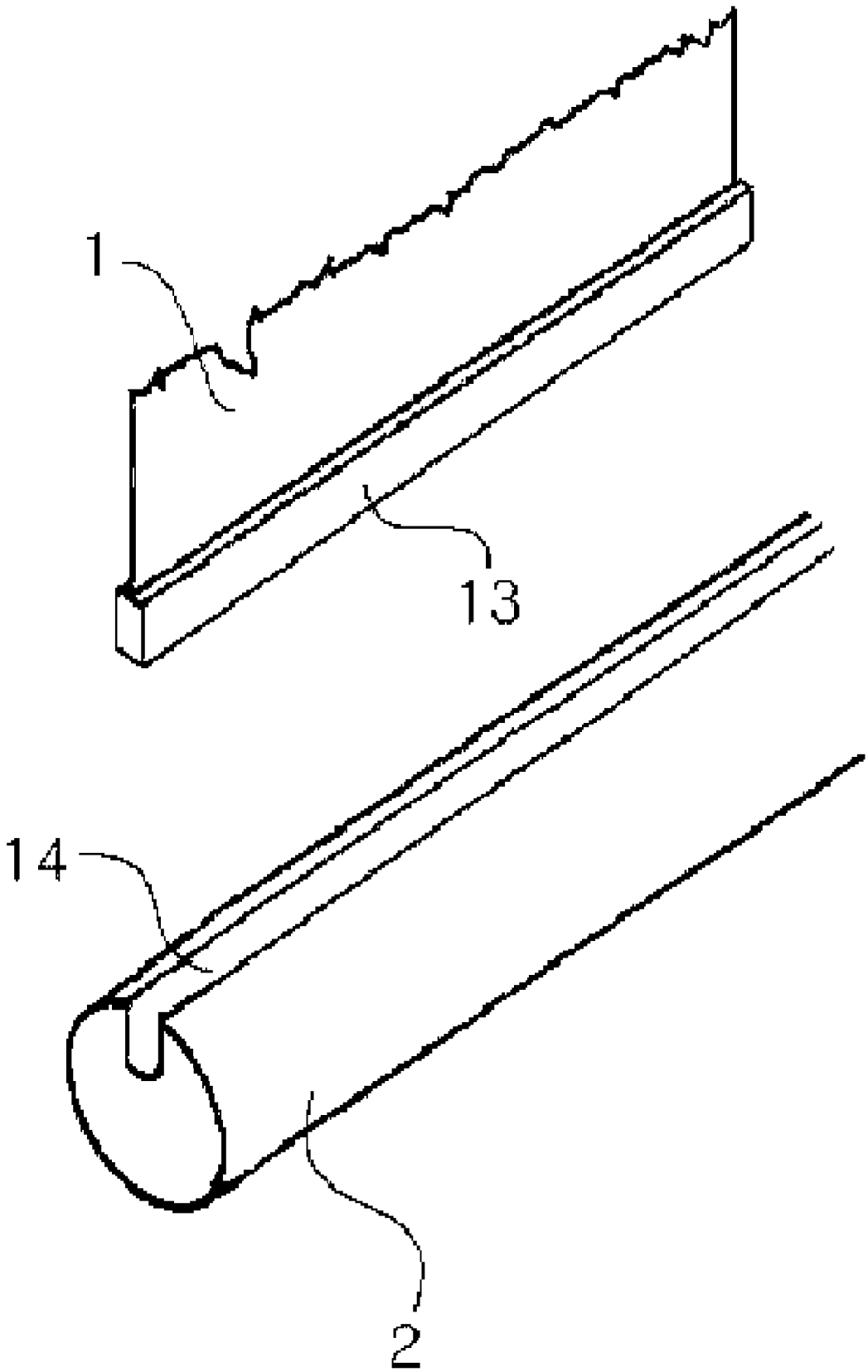

[Fig. 10]
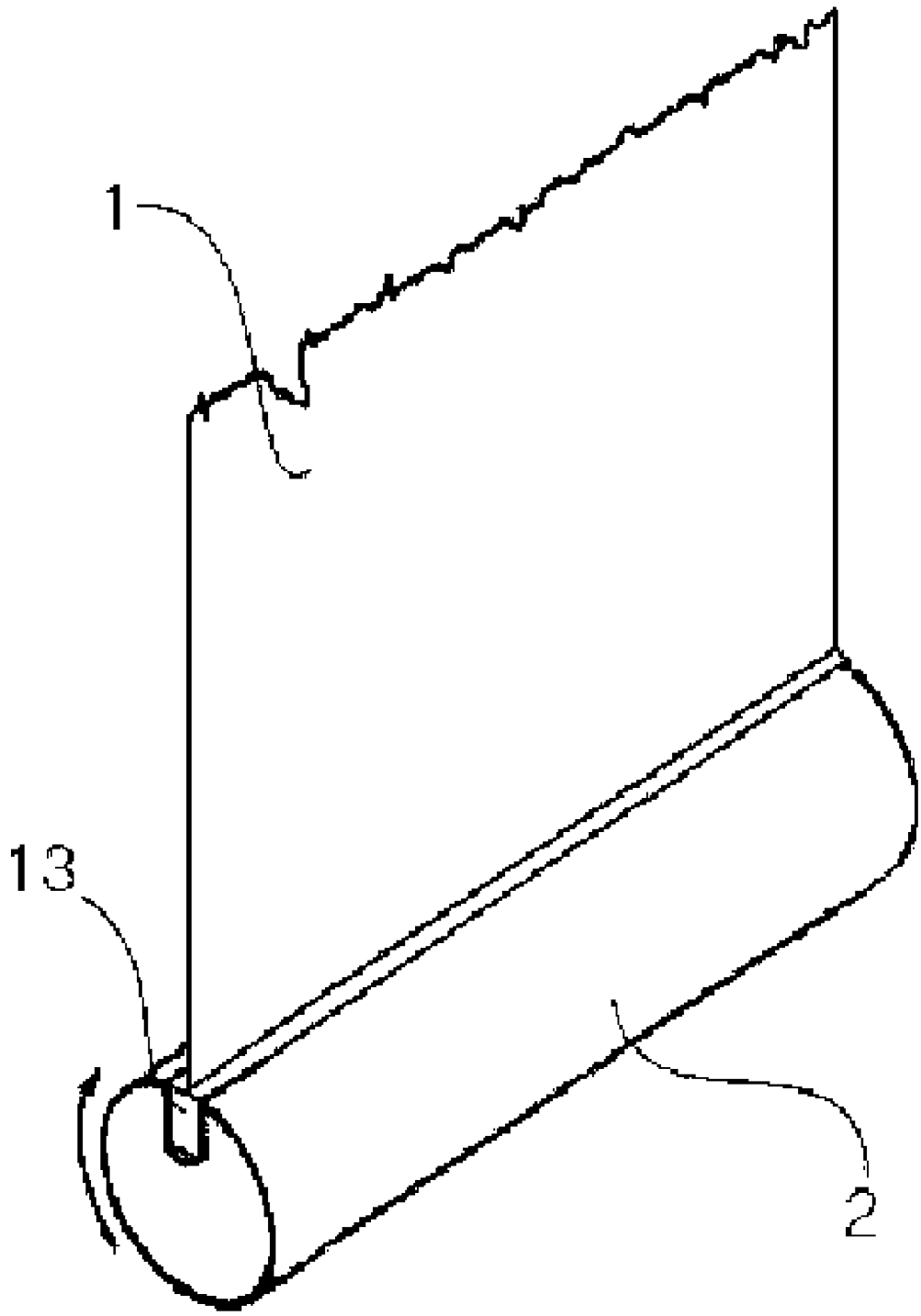

MULTIPURPOSE ADVERTISEMENT BOARD

CROSS REFERENCE TO RELATED APPLICATIONS

The present invention is the U.S. national phase of international PCT patent application serial number PCT/KR2007/000092, filed Jan. 6, 2007, which claims benefit of priority to Korean patent application serial number 20-2006-0019827, filed on Jul. 24, 2006.

TECHNICAL FIELD

The present invention relates to a multipurpose advertisement board. More particularly, the present invention relates to a multipurpose advertisement board having a plurality of glass plates, and winding rollers disposed in the space between the glass plates for winding respective ends of the film, each end having a piece of steel wire such that the pieces of steel wire are wound around the winding rollers, in which the multipurpose advertisement board can display a variety of designs printed on the film and can also serve as a normal window in the case in which the steel wire is long enough to extend the entire vertical length of the glass plates.

BACKGROUND ART

Generally, typical buildings use double glazed windows in order to reduce heat loss through windows and doors. Such a double glazed window generally includes a vacuum space between two glass plates constituting the double glazed window in order to minimize heat loss.

The double glazed window effectively reduces heat loss, but the light transmittance thereof cannot be adjusted, and thus a user generally uses curtains, blinds or sun blocking films in order to adjust the amount of incident light entering an indoor space. Further, since the color and light transmittance of the double glazed window cannot be changed once it is installed, an additional object is needed. Still further, in the case in which an advertisement material is attached to glass plates of the double glazed window for advertising purposes, since windows and doors in buildings generally remain as they are for their entire life span, the design of the windows remains unchanged for the entire lifespan thereof. That is, the windows or doors of the buildings are monotonous.

Further, in the case in which there is an apparatus having a blind or a film interposed between glass plates, no matter how transparent the film is, the transparency of the apparatus is inferior to an apparatus not having a film.

Still further, in the case in which a film is completely wound onto a winding roller, the film combined with the winding roller can be damaged by the strong shock that occurs when the film is completely wound thereon, and the film may become wrinkled as time passes.

DISCLOSURE OF INVENTION

Technical Problem

Accordingly, the present invention has been devised in consideration of the aforementioned problems and situations, and it is an object of the present invention to provide a multipurpose advertisement board having a structure in which a film is disposed between glass plates and can be moved and a starting end or an ending end of the film is connected to a piece of steel wire. The multipurpose advertisement window allows the multipurpose advertisement board to act as a normal transparent window when the steel wire is disposed in the space between the glass plates. The multipurpose advertisement window can select one film out of a number of films in order to display a variety of patterns through the glass plates by disposing the film in the space between the glass plates. Further, a piece of steel wire or transparent acryl is provided in the middle portion of the film in order to prevent the film from becoming wrinkled or folded.

In order to achieve the above-described advantageous effects and objects of the present invention, according to the embodiment of the present invention, there is provided a multipurpose advertisement board comprising a double glazed window including two or more glass plates which have outer edges that are fixed using a frame, and which are arranged in parallel at regular intervals, with a certain space between them, a film that moves in the space between the glass plates of the double glazed window, an upper winding roller and a lower winding roller installed at an upper side and a lower side of the double glazed window for winding the film in order to move the film, pieces of steel wire connected to the left and a right end of the film, respectively, and steel wire winding grooves formed in the upper winding roller and the lower winding roller, respectively, into which the two pieces of steel wire are wound, wherein the steel wire connected to a starting end or an ending end of the film is long enough so that the steel wire extends completely through the space between the glass plates when the film is completely wound, so that the double glazed window acts as a normal transparent window.

The multipurpose advertisement window may further comprise anti-wrinkling bars installed at locations where the pieces of steel wire and the film are connected and made of transparent acryl or steel wire for preventing the film from becoming wrinkled or folded, a guide protrusion installed in the space where the upper winding roller and the lower winding roller are installed and allowing the film, moved by the upper winding roller and the lower winding roller, to pass therethrough, and a stopper installed at an end portion of the steel wire for preventing the steel wire from being excessively wound and becoming separated from the winding rollers, thus preventing the film and steel wire from being damaged.

The multipurpose advertisement board may further comprise a weight bar installed at the lower end of the film, a weight bar insertion groove extending from one side to the other side of the lower winding roller, and a weight bar insertion detection sensor installed in the anti-wrinkle bar insertion groove, so that the multipurpose advertisement board may act as a transparent window when the film is completely wound around the upper winding roller if a transparent window is desired, but acts as an advertisement board by displaying a variety of patterns printed on the film by unrolling the film, which is accomplished as the weight bar falls down and is inserted and wound into the weight bar insertion grove if an advertisement board is needed.

Technical Solution

Hereinafter, embodiments of the present invention will be described with reference to the accompanying drawings.

FIG. 1 is a schematic view illustrating the process in which a piece of steel wire is combined with a lower winding roller of a multipurpose advertisement board according to one embodiment of the present invention, FIG. 2 is a view illustrating the process in which the lower winding roller of the multipurpose advertisement board according to one embodiment of the present invention is assembled, FIG. 3 is a view illustrating the process in which an upper winding roller of the multipurpose advertisement board according to one embodiment of the present invention is assembled, FIG. 4 is a perspective view illustrating the internal structure of the multipurpose advertisement board according to one embodiment of the present invention, FIG. 5 is a perspective view illustrating a connection part of a motor unit of the multipurpose advertisement board according to one embodiment of the present invention, FIG. 6 is a cross-sectional view illustrating a guide protrusion and a stopper of the multipurpose advertisement board according to one embodiment of the present invention, FIG. 7 is a schematic view illustrating the operation of the multipurpose advertisement board according to one embodiment of the present invention, and FIG. 8 is a schematic view illustrating a film connection portion of the multipurpose advertisement board according to one embodiment of the present invention.

First, a film 1 is prepared. The film 1 comprises a plurality of film strips having a variety of patterns and light transmittance, and the film strips are connected in series using an adhesive tape.

Of the film 1, connection portions, at which the film strips are connected using adhesive tape, are provided with anti-wrinkle bars 12 made of transparent acryl or a piece of steel wire, so the film 1 does not become folded or wrinkled. Further, respective ends of the film 1 are provided with a piece of steel wire, such as fishing string 11. The steel wire 11 and the film 1 are wound around an upper winding roller 3 and a lower winding roller 2.

The film 1, wound around either the upper winding roller or the lower winding roller, is installed in a manner such that it can move in order to adjust the degree of light incidence, darkness of an indoor space, and a picture (pattern, design) displayed in a window in consideration of the use and the purpose of the window. That is, the film 1 can be moved up and down by starting a motor using a switch provided on one side of the window or a remote switch, and by driving a belt shaft of the upper winding roller connected to the motor via a belt.

Further, since the pieces of steel wire 11 provided to the first end and a second end of the film are long enough, when the film 1 is completely wound around the winding rollers, a piece of steel wire 11 connected to the first end or the second end of the film remains unwound. In this state, not even a small amount of the film 1 remains in the space between glass plates 5 of a double glazed window, so that the glass plates act as a normal window.

On the other hand, according to other embodiment of the present invention, in the case in which the glass plates 5 act as a normal window, that is, the tape is not disposed in the space between the glass plates, as shown in FIG. 9 and FIG. 10, the anti-wrinkle bars 12, which are provided to the connection portions, can replace the pieces of steel wire 11 provided to the first and second ends of the film 1, and a weight bar 13 is provided to the lowermost end of the film. Further, the lower winding roller 2 may have an insertion groove 14 extending from one side to the other side thereof so that the weight bar 13 can be received in the insertion groove 14.

In this case, when the upper winding roller 3 is rotated and the film 1 is completely wound around the upper winding roller 3, the weight bar 13 provided to the lowermost end of the film 1 is separated from the lower winding roller 2 and is wound around the upper winding roller 3. Conversely, when the upper winding roller 3 is rotated in the direction in which the film is unrolled, the film falls down toward the lower winding roller 2 due to the weight of the weight bar 13 installed on the lowermost end of the film 1, and then the weight bar 13 is inserted into the insertion groove 14 of the lower winding roller 2. At this time, the lower winding roller 2 rotates, so that the film 1 can be wound around the lower winding roller 2. Until the lowermost end of the film 1 falls down into the insertion groove 14, the space between the glass plates acts as a rail, so that the lowermost end of the film 1 can be smoothly inserted into the insertion groove 14.

That is, if the film drops due to the weight of the weighing bar 13 along the space between the glass plates and is inserted into the insertion groove 14 of the lower winding roller 2, and then it is sensed that the weight bar 13 is inserted into the insertion groove 14, the lower winding roller 2 rotates so as to wind the film 1.

FIG. 2 is a view illustrating an assembled structure of the lower winding roller of the multipurpose advertisement board according to the embodiment of the present invention, and FIG. 3 is a view illustrating an assembled structure of the upper winding roller of the multipurpose advertisement board according to the embodiment of the present invention. Each of the upper winding roller 3 and the lower winding roller 2 has an end provided with a guide, a piece, a groove which can be combined with a bolt, and a nut for fixing the steel wire 11 thereto, and a belt shaft is fixed to a left side of each of the upper and lower winding rollers so that a free-wheel gear bearing is inserted therethrough and a free-wheel holder is connected to a side thereof.

The right side of the lower winding roller 2 is provided with a driving shaft assembled in a manner such that a washer and an elastic coil spring are inserted into a bearing holder through a hole of a bearing and the driving shaft is assembled using nuts. Accordingly, when the lower winding roller 2 is rotated in one direction, a force that tends to rotate the lower winding roller 2 in the opposite direction is generated, so that a certain amount of tension exists and the film can be pulled taut.

The upper winding roller 3 has a non-driving shaft 33, which can only passively rotate, at a right side thereof. Further, one side of the non-driving shaft is connected to the motor via a driving wire so that the upper winding roller can be rotated, and a plurality of film strips wound around the upper and lower winding roller can be moved at the same time when the upper winding roller is rotated.

The driving wire connected to one side of the non-driving shaft of the upper winding roller is pulled out so that a user can directly manipulate the upper winding roller. That is, the upper winding roller can be automatically and manually manipulated.

Further, one end of each of the upper winding roller and the lower winding roller has a steel wire groove 27, so that the steel wire 11 is wound into the steel wire groove 27 before the film is wound. As a result, when the film is wound around the winding roller, the thickness of the winding roller is increased due to the thickness of the steel wire 11.

Still further, the upper winding roller 3 and lower winding roller 2 are structured so as to be fixed to a wall at an upside portion and a lower side portion of a windowsill. Thanks to this structure, the film can be manipulated from within an indoor space so that it can act as a blind or a curtain even if the window is not a double glazed window.

FIG. 6 is a cross-sectional view illustrating a guide protrusion and a stopper of the multipurpose advertisement board according to the embodiment of the present invention. As shown in FIG. 6, the guide protrusion 6 is installed at the location where the upper winding roller 3 or the lower winding roller 2 is installed, and has a box shape so as to surround the upper winding roller 3 or the lower winding roller 2. The guide protrusion 6 further has a slit, serving as the guide for the film, at an upper portion thereof so that the film can pass through the slit.

The steel wire 11, provided to the starting end or the ending end of the film, has a stopper 111 so that the stopper 111 is hooked by the guide protrusion 6. As a result, the steel wire 11 is prevented from being separated from the winding rollers 2 and 3 due to a shock caused by strong winding.

The stopper 111 has a curved shape corresponding to the curve of the winding rollers so that the stopper 111 can be inserted into the steel wire groove 27 when the steel wire 11 is wound into the steel wire groove 27.

FIG. 7 is a schematic view illustrating the operation of the multipurpose advertisement board according to the embodiment of the present invention, and FIG. 8 is a schematic view illustrating the combination of the film and the multipurpose advertisement board.

As shown in FIG. 7, there is no film 1, but only the steel wire 11 is visible, so that the multipurpose advertisement board according to the present invention can act as a normal window. When the upper winding roller 3 is rotated as the motor connected to the upper winding roller 3 via the non-driving shaft 33 and the belt 37 rotates, the lower winding roller 2 is rotated by the elastic spring 24 in the lower winding roller 2 and the steel wire 11 is wound into the steel wire groove 27 of the lower winding roller 2, thus maintaining tension.

As described above, as the upper winding roller 3 and the lower winding roller 2 rotate, the film 1 goes down. Further, in the case in which the motor rotates in the opposite direction, the film goes up. At this time, since the film connection portions are provided with anti-wrinkle bars 12 made of transparent acryl or steel wire, the film 1 is not wrinkled or folded.

The present invention has been explained above with reference to embodiments thereof, but the present invention is not limited to the above-described embodiments. In concluding the detailed description, those skilled in the art will appreciate that many variations and modifications can be made to the preferred embodiments without departing from the principles of the present invention. Therefore, it will be readily understood that such variations and modifications to the preferred embodiment are within the scope of the present invention as defined in the claims.

Advantageous Effects

The structure and operation described above are expected to bear the following advantageous effects.

A film, having a variety of functions and patterns and having a width the same as the width of a window, is prepared, and the film comprises a plurality of film strips. The film strips are connected to each other in series and transparent acryl plates or pieces of steel wire are provided at the connection portions of the film strips, so that the film does not become wrinkled or folded. Since the lower winding roller includes an elastic spring, the film can be pulled taut. Since a piece of steel wire is provided at each end of the film, and the steel wire provided at the end of the film is long enough, the multipurpose advertisement board according to the present invention can act as a normal window having no film.

Since the guide protrusions are provided at locations at which the upper and lower winding rollers are installed, the film does not become separated from the winding rollers. Since the stoppers prevent the film from passing through the slit of the guide protrusion, it is possible to prevent the steel wire or the film from being damaged by strong force of winding.

BRIEF DESCRIPTION OF THE DRAWINGS

FIG. 1 is a schematic view illustrating the process in which a piece of steel wire is combined with a lower winding roller of a multipurpose advertisement board according to one embodiment of the present invention;

FIG. 2 is a view illustrating the process in which the lower winding roller of the multipurpose advertisement board according to one embodiment of the present invention is assembled;

FIG. 3 is a view illustrating the process in which an upper winding roller of the multipurpose advertisement board according to one embodiment of the present invention is assembled;

FIG. 4 is a perspective view illustrating the internal structure of the multipurpose advertisement board according to one embodiment of the present invention;

FIG. 5 is a perspective view illustrating a connection part of a motor unit of the multipurpose advertisement board according to one embodiment of the present invention;

FIG. 6 is a cross-sectional view illustrating a guide protrusion and a stopper of the multipurpose advertisement board according to one embodiment of the present invention;

FIG. 7 is a schematic view illustrating the operation of the multipurpose advertisement board according to one embodiment of the present invention;

FIG. 8 is a schematic view illustrating a film connection portion of the multipurpose advertisement board according to one embodiment of the present invention;

FIG. 9 is a perspective view illustrating the film and the lower winding roller of the multipurpose advertisement board according to another embodiment of the present invention, in which the film is not yet combined with the lower winding roller; and FIG. 10 is a perspective view illustrating the film and the lower winding roller of the multipurpose advertisement board according to another embodiment of the present invention, in which the film is already combined with the lower winding roller.

DETAILED DESCRIPTION OF THE KEY ELEMENTS IN DRAWINGS (1): film (2): lower winding roller
(3): upper winding roller (4): motor
(5): double glazed window (6): guide protrusion
(11): steel wire (12): anti-wrinkle bar
(13): weight bar (14): insertion groove
(21): guide (22): piece
(23): non-driving shaft (24): elastic spring
(25): washer (26): bearing holder
(27): steel wire groove (31): guide
(32): piece (33): non-driving shaft
(34): bearing holder (35): bearing holder
(36): nut (37): belt
(38): nut connection part (111): stopper

The invention claimed is:

1. A multipurpose advertisement board using a double glazed window, comprising:

a double glazed window including two or more glass plates having outer edges fixed using a frame, which are arranged in parallel at regular intervals, with a certain space between the glass plates;

a film moving in the space between the glass plates of the double glazed window; and an upper winding roller and a lower winding roller installed at an upper side and a lower side of the double glazed window for winding the film in order to move the film, the multipurpose advertisement board further comprising:

two pieces of steel wire connected to a left and a right end of the film, respectively; and steel wire winding grooves provided to the upper winding roller and the lower winding roller, respectively, for allowing the two pieces of steel wire to be wound, wherein the steel wire, connected to a starting end or an ending end of film, is long enough so that the steel wire extends an entire vertical length of the double glazed window when the film is completely wound, so that the double glazed window acts as a normal transparent window.

2. The multipurpose advertisement window according to claim 1, further comprising:

anti-wrinkling bars, installed at locations where the pieces of steel wire and the film are connected, and made of transparent acryl or steel wire for preventing the film from becoming wrinkled or folded;

a guide protrusion installed in the space where the upper winding roller and the lower winding roller are installed, and allowing the film, moved by the upper winding roller and the lower winding roller, to pass therethrough; and a stopper installed at an end portion of the steel wire for preventing the steel wire from being excessively wound and becoming separated from the winding rollers.

3. The multipurpose advertisement board according to claim 1, wherein the upper winding roller and the lower winding roller are structured so as to be fixed outside a windowsill, particularly to a wall at an upper side and a lower side of the windowsill.

4. A multipurpose advertisement board using a double glazed window, comprising:

a double glazed window including two or more glass plates, outer edges of which are fixed using a frame, which are arranged in parallel at regular intervals, with a certain space between the glass plates;

a film moving in the space between the glass plates of the double glazed window; and an upper winding roller and a lower winding roller installed at an upper side and a lower side of the double glazed window for winding the film in order to move the film, further comprising:

a weight bar installed at a lower end of the film; and a weight bar insertion groove extending from one side to another side of the winding roller, wherein the film is completely wound around the upper winding roller so that the multipurpose advertisement board acts as a normal transparent window if a normal transparent window is needed, but the film is stretched as the weight bar, dropping from the upper winding roller, is inserted and wound into the weight bar insertion groove, so that the multipurpose advertisement board acts as an advertisement board by displaying a variety of patterns printed on the film if an advertisement board is needed.

5. The multipurpose advertisement board according to claim 4, wherein the upper winding roller and the lower winding roller are structured so as to be fixed outside a windowsill, particularly to a wall at an upper side and a lower side of the windowsill.

* * * * *